US008844095B2

(12) United States Patent
Hawkins et al.

(10) Patent No.: US 8,844,095 B2
(45) **Date of Patent: *Sep. 30, 2014**

(54) FLOOR CARE APPARATUS WITH CORD REEL AND NOZZLE ASSEMBLY

(75) Inventors: Kyle A. Hawkins, Stanford, KY (US); Michael L. Fry, Danville, KY (US); Samuel A. Marsh, Ligonier, PA (US); Ryan T. Dant, Richmond, KY (US); Shannon D. Phegley, Danville, KY (US); Eric J. Streciwilk, Danville, KY (US)

(73) Assignee: Panasonic Corporation of North America, Secaucus, NJ (US)

( * ) Notice: Subject to any disclaimer, the term of this patent is extended or adjusted under 35 U.S.C. 154(b) by 6 days.

This patent is subject to a terminal disclaimer.

(21) Appl. No.: 13/337,744

(22) Filed: Dec. 27, 2011

(65) Prior Publication Data

US 2012/0167333 A1 Jul. 5, 2012

Related U.S. Application Data

(60) Provisional application No. 61/429,940, filed on Jan. 5, 2011, provisional application No. 61/530,085, filed on Sep. 1, 2011.

(51) Int. Cl.
*A47L 11/00* (2006.01)

(52) U.S. Cl.
USPC ..... 15/413; 15/351; 15/DIG. 10

(58) Field of Classification Search
USPC ..... 15/413, DIG. 10, 351
IPC ..... A47L 11/00
See application file for complete search history.

(56) References Cited

U.S. PATENT DOCUMENTS

| | | | | |
|---|---|---|---|---|
| 1,260,282 | A * | 3/1918 | Harrold | 417/368 |
| 1,897,087 | A | 2/1933 | Tamarin | |
| 2,487,395 | A * | 11/1949 | Strang | 191/12.2 R |
| 2,591,214 | A | 4/1952 | Tamarin | |
| 2,825,086 | A | 3/1958 | Tamarin | |
| 2,937,396 | A | 5/1960 | Momberg et al. | |
| 3,275,760 | A | 9/1966 | Gaudry | |
| 3,308,247 | A | 3/1967 | Doersam et al. | |
| 3,469,272 | A | 9/1969 | Gaudry et al. | |
| 3,999,640 | A | 12/1976 | Persson | |
| 4,204,297 | A | 5/1980 | Yasunaga et al. | |
| 4,967,862 | A | 11/1990 | Pong et al. | |
| 5,023,410 | A | 6/1991 | Danielson et al. | |
| 5,168,598 | A | 12/1992 | Hashizume et al. | |
| 7,739,772 | B2 | 6/2010 | Park | |
| 2006/0137129 | A1 | 6/2006 | Schroter | |
| 2007/0209895 | A1 | 9/2007 | Oh et al. | |

* cited by examiner

*Primary Examiner* — David Redding
(74) *Attorney, Agent, or Firm* — King & Schickli, PLLC

(57) ABSTRACT

A floor care apparatus includes a body having a nozzle assembly and a handle assembly. The handle assembly is pivotally attached to the nozzle assembly. Both a suction generator and a dirt collection vessel are carried on the body. Further, the nozzle assembly includes a cord reel.

27 Claims, 5 Drawing Sheets

FLOOR CARE APPARATUS WITH CORD REEL AND NOZZLE ASSEMBLY

This application claims the benefit of U.S. Provisional Patent Application Ser. No. 61/429,940, filed on 5 Jan. 2011, and U.S. Provisional Patent Application Ser. No. 61/530,085, filed on 1 Sep. 2011, the full disclosures of which are incorporated herein by reference.

TECHNICAL FIELD

The present invention relates generally to the floor care equipment field and, more particularly, to a floor care apparatus, such as an upright vacuum cleaner, incorporating a cord reel in the nozzle assembly.

BACKGROUND OF THE INVENTION

Floor care equipment such as upright vacuum cleaners and extractors, are well known in the art. An upright vacuum cleaner generally includes a body having both a nozzle assembly and a handle assembly. A suction generator and dirt collection vessel are both carried on the body. The nozzle assembly has a suction inlet and a rotary agitator that beats dirt and debris from the nap of an underlying carpet being cleaned. The handle assembly is pivotally connected to the nozzle assembly and is moved into an inclined position to allow the operator to guide the vacuum cleaner to and from across the floor.

Cord reel assemblies for vacuum cleaners are well known in the art. Such a cord reel assembly generally includes a reel upon which the electrical power cord of the appliance is wound and stored. During use the operator unwinds the cord from the reel and connects the electrical plug to a standard electrical wall outlet. Following use the electrical plug is unplugged from the wall outlet and the cord is rewound on the reel for storage. U.S. Pat. No. 5,023,410 to Danielson et al discloses one possible construction for a cord reel.

In the past the cord reel on an upright vacuum cleaner has been positioned on the pivoting handle assembly. This has been done for a number of reasons including the fact that the handle assembly has more room than the nozzle assembly to accommodate the cord reel and for operator convenience. An example of an upright vacuum cleaner equipped with a cord reel on the handle assembly is found in U.S. Pat. No. 5,168,598 to Hashizume et al. While such a cord reel is useful for its intended purpose, the positioning of the cord reel in the handle or canister assembly suffers from various drawbacks.

First, the weight of the cord reel in a handle assembly is positioned well above the center of gravity of the vacuum cleaner where it has a tendency to promote the inadvertent tipping over of the vacuum cleaner. Second, the opening on the handle assembly from which the electrical cord extends is positioned at a height well above the floor. In the event the electrical cord slips from the grasp of the operator, the spring loading of the reel which allows the rewinding of the cord onto the reel for storage may cause the free electrical cord to whip upwardly striking the operator.

The present invention relates to an upright vacuum cleaner equipped with a cord reel that is positioned in the nozzle assembly adjacent to ground. Thus, the cord reel is positioned closer to the floor where it will not promote potential tipping of the vacuum cleaner. Advantageously, this lowers the center of gravity of the vacuum cleaner thereby increasing its stability. In addition, by positioning the electrical cord payout opening closer to the ground, the potential of being struck above the knees by a free electrical cord during the rewinding operation is substantially reduced.

SUMMARY OF THE APPARATUS

A floor care apparatus is provided comprising of a body including a nozzle assembly and a handle assembly pivotally attached to the nozzle assemble. Both a suction generator and a dirt collection vessel are carried on the body. In addition, the apparatus includes a cord reel in the nozzle assembly.

More particularly describing the floor care apparatus, the nozzle assembly includes a suction generator chamber for receiving and holding the suction generator, a cord reel chamber for receiving and holding the cord reel and a handle mount for pivotally mounting the handle assembly to the nozzle assembly. The handle mount is positioned between the suction generator chamber and the cord reel chamber.

The nozzle assembly further includes an airflow passageway that directs an airstream from an exhaust port of the suction generator chamber into an inlet port of the cord reel chamber. The airflow passageway is provided adjacent and parallel to the suction inlet of the nozzle assembly. That suction inlet is connected to a suction duct and the air flow passageway crosses the suction duct. Further the air flow passageway extends transversely across the nozzle assembly between the (a) the suction generator and cord reel chambers on a first side and (b) the suction inlet on a second side.

The nozzle assembly further includes a housing that defines a cover of the cord reel assembly. That cover includes an electrical cord opening. The electrical power cord received on the cord reel includes a plug and extends through the electrical cord opening. That electrical cord opening is provided no more than 17 centimeters above the bottom plate of the vacuum cleaner when the vacuum cleaner is positioned on a floor in the operating position.

BRIEF DESCRIPTION OF THE DRAWINGS

The accompanying drawings incorporated herein and forming a part of the specification, illustrate several aspects of the floor care apparatus and together with the description serve to explain certain principles of the device. In the drawings:

FIG. 5 is a detailed perspective view of the nozzle assembly illustrating the flow of air there through;

Reference will now be made in detail to the present preferred embodiment of the apparatus, an example of which is illustrated in the accompanying drawings.

DETAILED DESCRIPTION OF THE PREFERRED EMBODIMENTS

Reference is now made to FIGS. 1-4 illustrating an upright vacuum cleaner 10. The upright vacuum cleaner 10 includes a body comprising a nozzle assembly 12 and a canister or handle assembly 14. The handle assembly 14 is pivotally connected to the nozzle assembly 12 by means of a twin pivot connector arm 18. The details of the connector arm 18 are not relevant to this discussion but can be found in co-pending U.S. patent application Ser. No. 13/223,615, now U.S. Pat. No. 8,661,613, the full disclosure of which is incorporated herein by reference.

Figure 4:
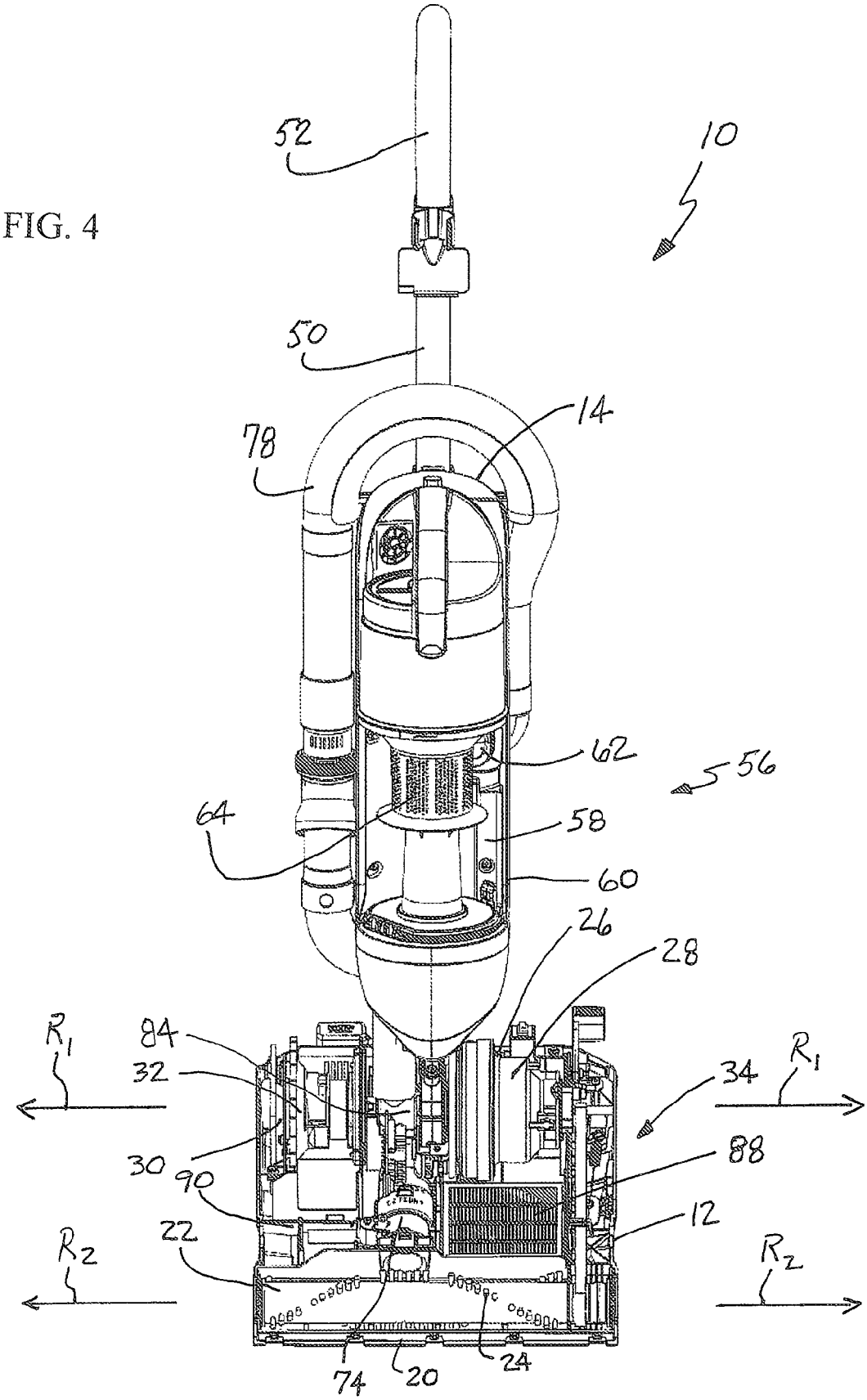
FIG. 4 is a top plan view of the upright vacuum cleaner with the cover of the nozzle housing assembly removed to illustrate the positioning of the various internal components and the handle assembly in the inclined, use position.

As illustrated best in FIG. 4, the nozzle assembly 12 includes a suction inlet 20. A rotary agitator 22 is carried on the nozzle assembly 12 in the mouth of the suction inlet 20. The rotary agitator 22 may be equipped with bristle tufts 24 or other projecting structures of a type known in the art to beat dirt and debris from the nap of the underlying carpet during vacuum cleaner operation. The nozzle assembly 12 also includes a suction generator chamber 26 for receiving and holding the suction generator 28 and a cord reel chamber 30 for receiving and holding a cord reel 32.

The suction generator 28 comprises a combined motor and fan assembly. The rotary agitator 22 is driven by the motor of the suction generator 28 through a PTO drive which is illustrated in drawing FIG. 4 as comprising a belt and pulley system generally designated by reference numeral 34. The details of such a belt and pulley system may be found in, for example, Co-Pending U.S. patent application Ser. No. 13/223,579, filed on 1 Sep. 2011, now Published U.S. Patent Application No. 20120167334 and entitled BELT SHIFTER MECHANISM, the full disclosure of which is incorporated herein by reference.

An electrical power cord 36 is wound onto the cord reel 32. As should be appreciated from viewing FIGS. 1, 2 and 5, the nozzle assembly 12 includes a housing 38 having a bottom plate 40, an agitator shield 41, a removable two-piece cover 42 and a resilient bumper 43. The suction inlet 20 is provided in the bottom plate 40. An electrical cord opening 44 is provided in the cover 42. The electrical power cord 36 extends or projects through the electrical cord opening 44. The plug 46 on the end of the electrical power cord 36 is larger than the opening 44 so as to always to be exposed for easy access by the operator. As should be appreciated, the electrical cord opening 44 is provided less than 17 vertical centimeters above the bottom plate 40 when the vacuum cleaner 10 is resting in an operating position on an underlying floor.

As best illustrated in FIG. 4, the handle assembly 14 includes a control stalk 50 having a hand grip 52. In the illustrated embodiment, the switch 54 for controlling the operation of the vacuum cleaner 10 (i.e. turning the vacuum cleaner on and off) is provided on the nozzle assembly 12. However, it should be appreciated that switch 54 could be provided along the control stalk 50 adjacent to hand grip 52 if desired. The handle assembly 14 also carries a dirt collection vessel generally designated by reference numeral 56. In the illustrated embodiment the dirt collection vessel 56 comprises a reusable dirt cup 58. The dirt cup 58 may include a cylindrical sidewall 60, a tangentially directed inlet 62 and an axially directed outlet (not shown) covered by a filtering shroud 64 so as to provide cyclonic cleaning action. A primary filter (also not shown) may be provided in the dirt cup 58 or downstream from the dirt cup as desired. In an alternative embodiment, the dirt collection vessel 56 may comprise a vacuum cleaner filter bag of a type known in the art held in a filter bag compartment provided in the handle assembly 14.

Figure 1:
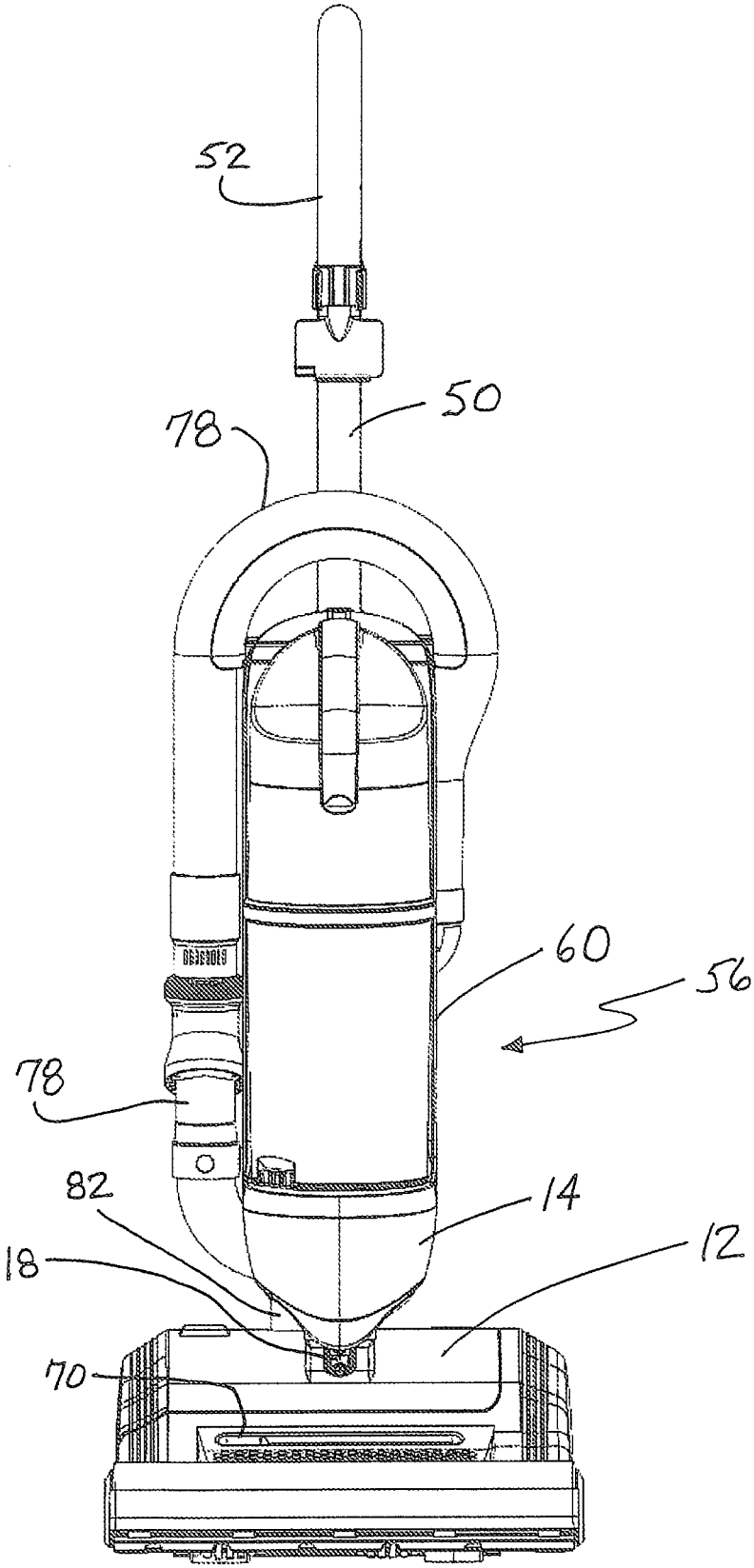
FIG. 1 is a front elevation view of one possible embodiment of the floor care apparatus including a cord reel in the nozzle assembly.
Figure 2:
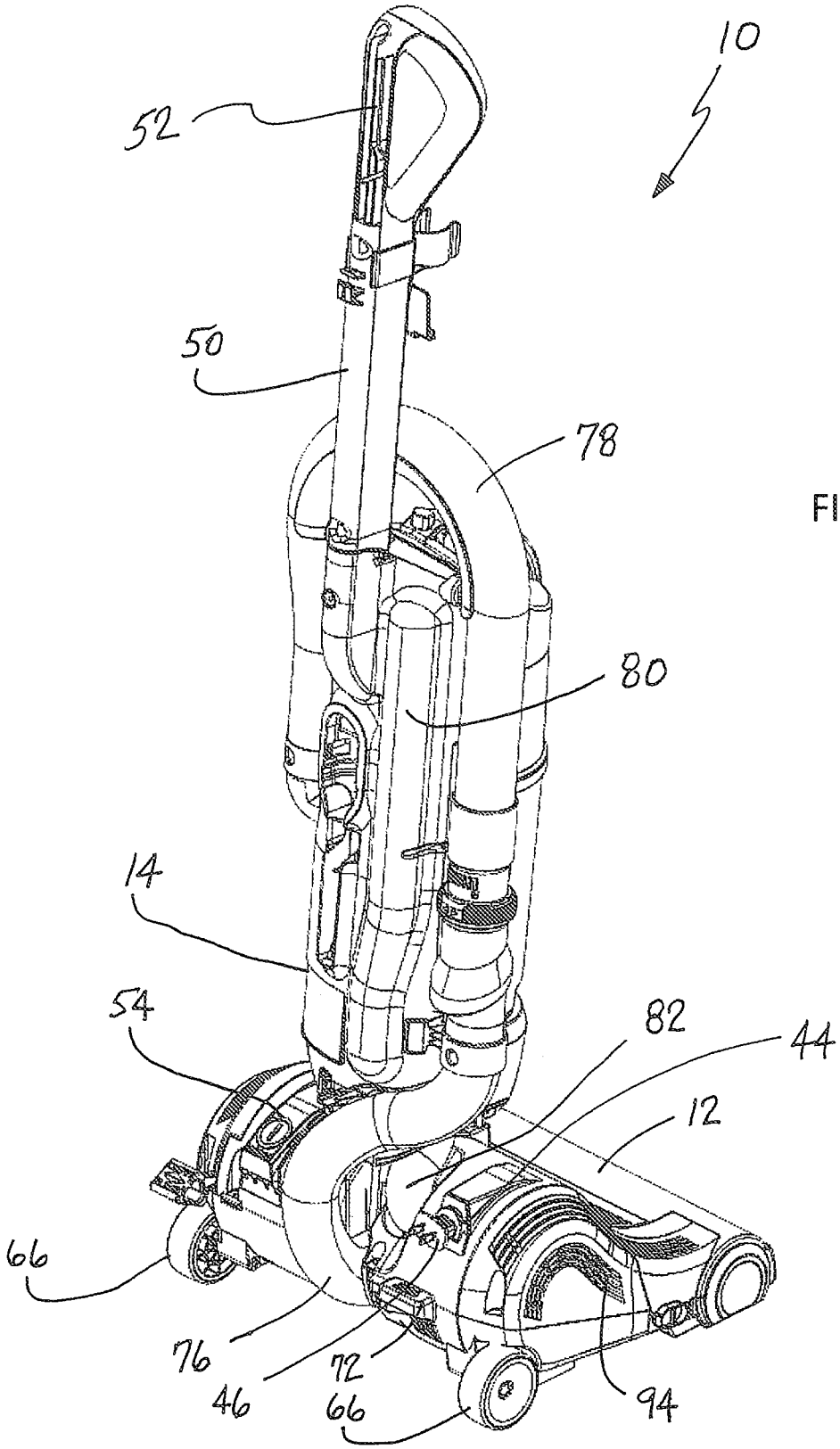
FIG. 2 is a rear perspective view of the floor care apparatus illustrated in FIG. 1.
Figure 3:
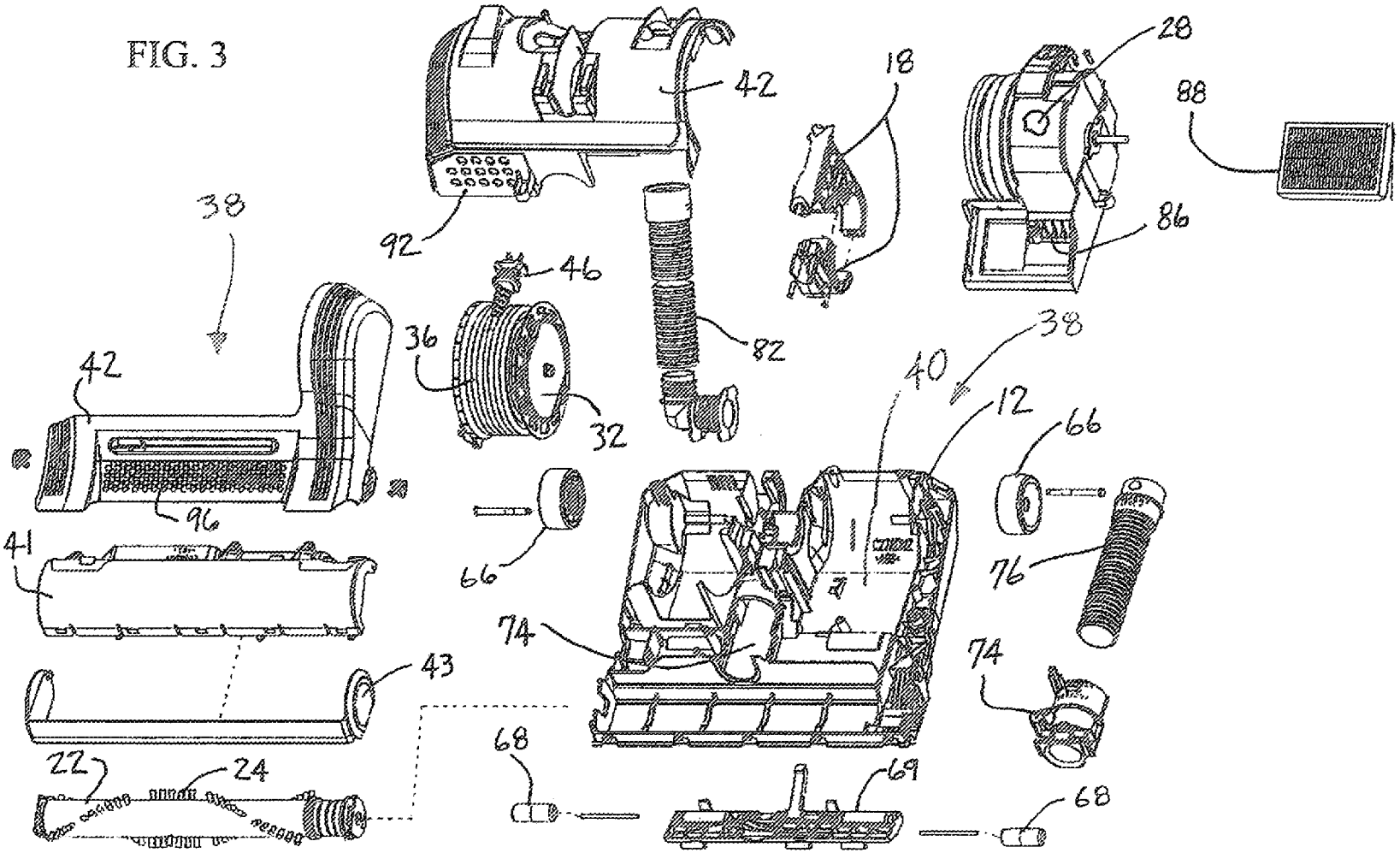
FIG. 3 is an exploded perspective view of the nozzle assembly of the floor care apparatus.

The vacuum cleaner 10 is supported for movement along a floor on a series of wheels. More specifically, as illustrated in FIGS. 1 and 2, the nozzle assembly 12 carries a pair of rear wheels 66 and one or more forward wheels or rollers 68 on a fulcrum plate 69 that allow for height adjustment of the vacuum cleaner 10 with respect to the floor. Such height adjustment may be made by manipulating a height adjustment lever 70 that projects from the nozzle assembly 12 and is connected to a height adjustment mechanism (not shown) of a type known in the art. The lever 72 is depressed in order to release a lock that secures the handle assembly 14 in an upright storage position.

During vacuum cleaner 10 operation, the rotary agitator 22 is driven by the motor of the suction generator 28 and functions to sweep dirt and debris from the nap of the underlying carpet. The suction generator 28 also functions to draw a vacuum air stream into the suction inlet 20. Dirt and debris from the carpet is entrained in that air stream which is drawn by the suction generator 26 from the suction inlet 20 serially through the suction duct 74, flexible hose 76 and the conduit 78 into the tangentially directed inlet 62 of the dirt collection vessel 56. Dirt and debris are captured in the dirt collection vessel 56 while relatively clean air is drawn serially through an air stream conduit 80, the flexible hose 82 and the air stream conduit 84 into the suction generator chamber 26. The air stream is then forced by the fan over the motor of the suction generator 28 so as to provide cooling. The air stream then passes through the exhaust port 86 of the suction generator chamber 26 and then through a final filter 88 covering that exhaust port. Next the air stream passes transversely across the nozzle assembly 12 through an air flow passageway 90.

Figure 5:
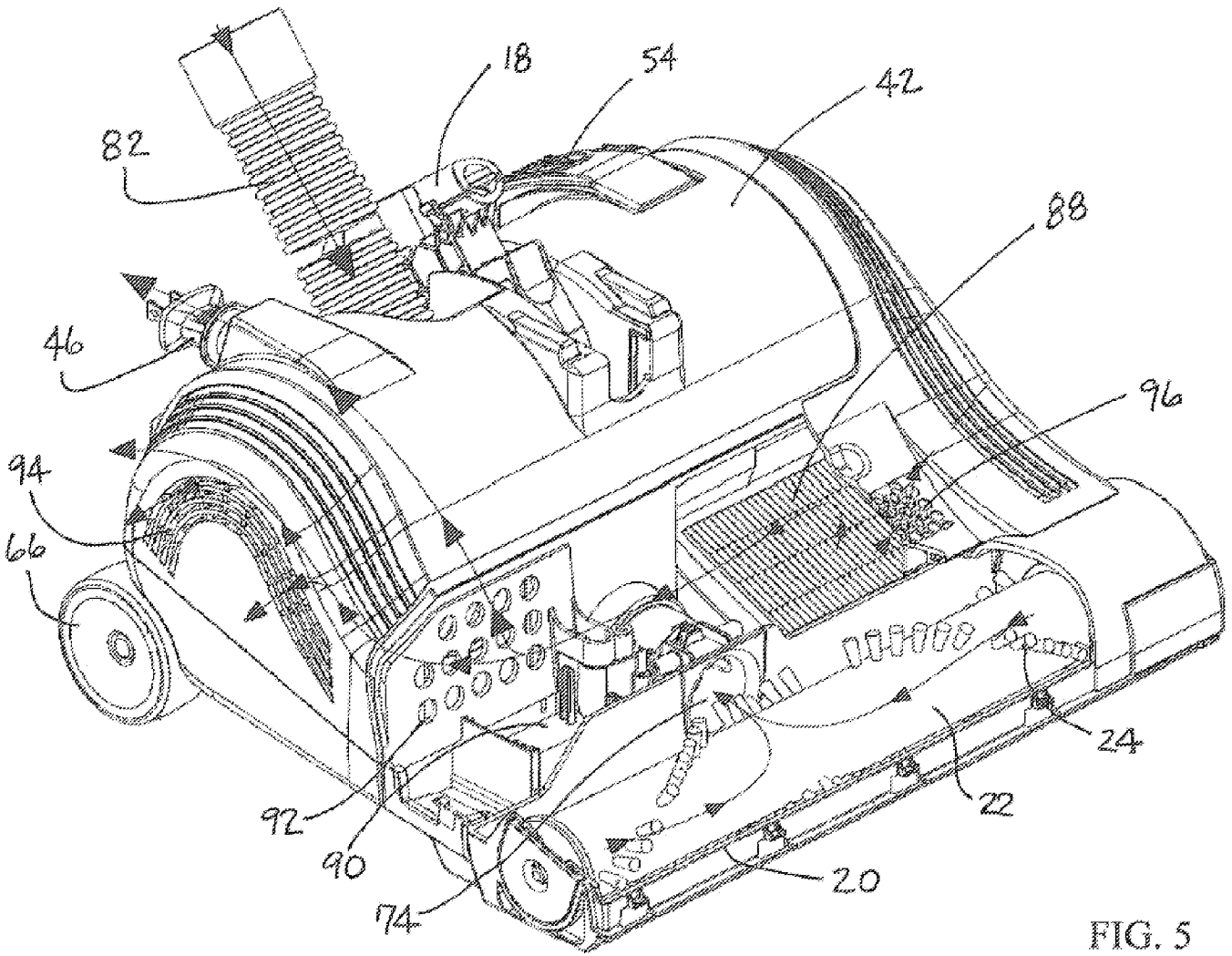

As best illustrated in FIGS. 4 and 5, the air flow passageway 90 directs the air stream from the exhaust port 86 of the suction generator chamber 26 into an inlet port 92 of the cord reel chamber 30. The air stream flows over the cord reel 32, any electrical cord 36 remaining wound on the cord reel and the electrical contacts (not shown) of the cord reel to provide cooling before being exhausted into the environment through the exhaust vent 94. It should be appreciated that an additional exhaust vent 96 may be provided in the cover 42 in direct communication with the air flow passageway 90. Thus, while one portion of the air stream is vented through the exhaust vent 96 directly from the air flow passageway into the ambient environment, another portion of the air stream flows through the cord reel chamber 30 over the cord reel 32 to provide cooling before being vented through the exhaust vent 94 into the ambient environment. This vent 96 relieves back pressure that might otherwise reduce the suction power and cleaning efficiency of the vacuum cleaner 10.

As best illustrated in FIGS. 4 and 5, it should be appreciated that the air flow passageway 90 extends transversely across the nozzle assembly 12 between the (a) the suction generator and cord reel chambers 26, 30 on a first side and (b) the suction inlet 20 on a second side. Further, the air flow passageway 90 crosses over the suction duct 74 that is connected to the suction inlet 20.

In summary, numerous benefits result in employing the concepts disclosed in this document. Specifically, the cord reel chamber 32 is provided at the rear of the nozzle assembly 12 on one side of the handle mount or connector arm 18 while the suction generator 28 is mounted at the rear of the nozzle assembly on the opposite side thereof. This functions to spread the weight fairly evenly on both sides of the vacuum cleaner. As should be appreciated the cord real 32 has a first axis of rotation R1 and the rotary agitator 22 has a second axis of rotation R2 where the axis of rotation are provided parallel to one another. The air flow passageway 90 extends transversely across the nozzle assembly 12 between the suction generator and cord reel chambers 26, 30 on the one side and the suction inlet 20 on the other side where it can provide sufficient space for receiving the final filter 88 while still maintaining a compact design. Further, the front portion of the nozzle assembly 12 still maintains a low profile for cleaning under cabinets and along the toe plates thereof and the like.

Advantageously, the positioning of the cord reel 32 in the nozzle assembly 12 rather than the handle assembly 14 as in previous upright vacuum cleaner designs removes weight from the handle assembly and places it lower to the ground thereby increasing the stability of the vacuum cleaner 10. Further, by placing the electrical cord opening 44 in the nozzle assembly cover 42 within 17 or fewer centimeters of the bottom plate 40, the electrical cord 36 and plug 46 are placed in a convenient rearwardly facing orientation (i.e. in a direction facing away from the suction inlet 20) where the plug may be conveniently accessed by the operator. Further, if the operator inadvertently drops the end of the cord 36 as it is being retracted by the cord reel 32 into the nozzle assembly 12, the cord is positioned low where it has the least potential to strike the operator.

The foregoing description of the preferred embodiment of the present device has been presented for purposes of illustration and description. It is not intended to be exhaustive or to limit the device to the precise form disclosed. Obvious modifications or variations are possible in light of the above teachings. The embodiments were chosen and described to provide the best illustration of the principles of the device and its practical application to thereby enable one of ordinary skill in the art to utilize the device in various embodiments and with various modifications as are suited to the particular use contemplated. All such modifications and variations are within the scope of the device as determined by the appended claims when interpreted in accordance with the breadth to which they are fairly, legally and equitably entitled. The drawings and preferred embodiments do not and are not intended to limit the ordinary meaning of the claims in their fair and broad interpretation in any way.

What is claimed:

1. A floor care apparatus, comprising:

a body including a nozzle assembly and a handle assembly pivotally attached to said nozzle assembly;

a suction generator carried on said body; and a dirt cup carried on said body;

said apparatus being further characterized by said nozzle assembly including a cord reel.

2. The apparatus of claim 1, wherein said nozzle assembly includes a cord reel compartment that receives and holds said cord reel, said cord reel compartment further including a cooling air inlet and an exhaust outlet.

3. The apparatus of claim 2, wherein said suction generator is connected to said cooling air inlet.

4. The apparatus of claim 3, wherein said nozzle assembly includes a housing having a bottom plate and a cover, said bottom plate including a suction inlet and said cover including an electrical cord opening.

5. The apparatus of claim 4, further including an electrical power cord wound onto said cord reel and projecting through said electrical cord opening wherein said electrical cord opening is provided no more than 17 vertical centimeters above said bottom plate when said vacuum cleaner is positioned on a floor in an operating position.

6. The apparatus of claim 4, wherein said nozzle assembly includes (a) a suction generator chamber receiving and holding said suction generator, (b) a cord reel chamber receiving and holding said cord reel and (c) a handle mount pivotally mounting said handle assembly to said nozzle assembly.

7. The apparatus of claim 6, wherein said airflow passageway is adjacent and parallel to a suction inlet provided on said nozzle assembly.

8. The apparatus of claim 7, wherein said suction inlet is connected to a suction duct and said airflow passageway crosses said suction duct.

9. The apparatus of claim 8, wherein said airflow pathway extends transversely across said nozzle assembly between (a) said suction generator and cord reel chambers on a first side and (b) said suction inlet on a second side.

10. The apparatus of claim 6, wherein said nozzle assembly includes a housing having a bottom plate and a cover, said bottom plate including a suction inlet and said cover including an electrical cord opening.

11. The apparatus of claim 10, further including an electrical power cord wound onto said cord reel and projecting through said electrical cord opening wherein said electrical cord opening is provided no more than 17 vertical centimeters above said bottom plate when said vacuum cleaner is positioned on a floor in an operating position.

12. The apparatus of claim 6, further including a rotary agitator carried in said nozzle assembly and wherein said cord reel has a first axis of rotation and said rotary agitator has a second axis of rotation where said first axis of rotation and said second axis of rotation are parallel to one another.

13. The apparatus of claim 12, wherein an electrical cord opening opens rearwardly on said nozzle assembly away from said suction inlet.

14. The apparatus of claim 12, wherein a first exhaust vent is provided in said housing and a second exhaust vent is provided in said housing in communication with said cord reel compartment whereby a first portion of said airstream from said suction generator is exhausted from said first exhaust vent directly into ambient air while a second portion of said airstream from said suction generator is passed over said cord reel to provide cooling before being exhausted from said second exhaust vent directly from said cord reel compartment into ambient air.

15. The apparatus of claim 14, further including a filter mounted over an exhaust port of said suction generator.

16. A floor care apparatus, comprising:

a body including a nozzle assembly and a handle assembly pivotally attached to said nozzle assembly wherein said nozzle assembly includes (a) a suction generator chamber receiving and holding a suction generator, (b) a cord reel chamber receiving and holding a cord reel, (c) a handle mount pivotally mounting said handle assembly to said nozzle assembly and (d) an airflow passageway directing an airstream from an exhaust port of said suction generator chamber into an inlet port of said cord reel chamber; and a dirt collection vessel carried on said body.

17. The apparatus of claim 16, wherein said chamber further including a cooling air inlet and an exhaust outlet.

18. The apparatus of claim 17, wherein said suction generator is connected to said cooling air inlet.

19. The apparatus of claim 18, wherein said nozzle assembly includes a housing having a bottom plate and a cover, said bottom plate including a suction inlet and said cover including an electrical cord opening.

20. The apparatus of claim 19, further including an electrical power cord wound onto said cord reel and projecting through said electrical cord opening wherein said electrical cord opening is provided no more than 17 vertical centimeters above said bottom plate when said vacuum cleaner is positioned on a floor in an operating position.

21. The apparatus of claim 19, wherein said airflow passageway is adjacent and parallel to a suction inlet provided on said nozzle assembly.

22. The apparatus of claim 21, wherein said suction inlet is connected to a suction duct and said airflow passageway crosses said suction duct.

23. The apparatus of claim 22, wherein said airflow pathway extends transversely across said nozzle assembly between (a) said suction generator and cord reel chambers on a first side and (b) said suction inlet on a second side.

24. The apparatus of claim 19, further including a rotary agitator carried in said nozzle assembly and wherein said cord reel has a first axis of rotation and said rotary agitator has a second axis of rotation where said first axis of rotation and said second axis of rotation are parallel to one another.

25. The apparatus of claim 24, wherein an electrical cord opening opens rearwardly on said nozzle assembly away from said suction inlet.

26. The apparatus of claim 24, wherein a first exhaust vent is provided in said housing and a second exhaust vent is provided in said housing in communication with said cord reel chamber whereby a first portion of said airstream from said suction generator is exhausted from said first exhaust vent directly into ambient air while a second portion of said airstream from said suction generator is passed over said cord reel to provide cooling before being exhausted from said second exhaust vent directly from said cord reel chamber into ambient air.

27. The apparatus of claim 26, further including a filter mounted over an exhaust port of said suction generator.

* * * * *